US005235129A

United States Patent [19]

Corney

[11] Patent Number: 5,235,129

[45] Date of Patent: Aug. 10, 1993

[54] HIGH CAPACITY ELECTRICAL CARTRIDGE INTERCONNECT

[75] Inventor: Martin Corney, Glendora, Calif.

[73] Assignee: Hughes Aircraft Company, Los Angeles, Calif.

[21] Appl. No.: 786,445

[22] Filed: Nov. 1, 1991

[51] Int. Cl.[5] ..... F42B 5/08

[52] U.S. Cl. ..... 102/472; 42/84; 89/28.05

[58] Field of Search ..... 102/472, 700; 42/84; 89/28.05, 28.1, 28.2, 135

[56] References Cited

U.S. PATENT DOCUMENTS

| | | | |
|---|---|---|---|
| 1,108,717 | 8/1914 | Davis | 89/28.05 |
| 3,169,333 | 2/1965 | Scanlon, Jr. | 102/700 |
| 3,563,177 | 2/1971 | Ritchey | 42/84 |
| 3,714,728 | 2/1973 | Perkins et al. | 42/84 |
| 3,748,770 | 7/1973 | Mitchell | 42/84 |
| 4,285,153 | 8/1981 | Crouch | 42/84 |

FOREIGN PATENT DOCUMENTS

| | | | |
|---|---|---|---|
| 324113 | 7/1989 | European Pat. Off. | 102/472 |
| 2949130A1 | 6/1981 | Fed. Rep. of Germany | 89/28.05 |
| 2527666 | 10/1985 | Fed. Rep. of Germany | 89/135 |
| 46-4478 | 2/1971 | Japan | 102/472 |
| 1102201 | 2/1968 | United Kingdom . | |

*Primary Examiner*—Stephen M. Johnson
*Attorney, Agent, or Firm*—C. D. Brown; R. M. Heald; W. K. Denson-Low

[57] ABSTRACT

A system for controlling the application of firing signals to electrically fired ammunition rounds which are chambered in the gun or the like. A plurality of insulated contacts are installed in the firing chamber wall so as to connect electrically to mating insulated contacts which are built into the case of the chambered round. Various configurations of annular contact rings are provided for both the inner surface of a gun firing chamber and for the mating exterior surface of a cartridge to be positioned therein. Timing control circuitry for such systems is also disclosed, suitable for use in a single barrel gun or a multiple barrel gun of the Gatling type or a revolving chamber gun with one or more fixed barrels.

26 Claims, 5 Drawing Sheets

HIGH CAPACITY ELECTRICAL CARTRIDGE INTERCONNECT

BACKGROUND OF THE INVENTION

1. Field of the Invention

This invention involves arrangements for reliably conducting electrical energy at high levels and, more particularly, electrical circuitry systems which conduct high energy electrical pulses to and from a cartridge case or a similar device which is chambered in a gun.

2. Description of the Related Art

For cartridge cases and similar devices which are installed and removed rapidly from a gun barrel or mating connection or enclosure, it may be necessary to transfer large pulses of electrical energy. In existing electrically primed cartridges used in automatic cannon, typically small pulses of electrical energy are used to fire the electrical primers. Whether the gun system is self powered or externally powered, an insulated "firing pin" contact located in the face of the bolt or breechblock contacts or indents into a centrally located primer component which is located in the base or bottom of the cartridge case. This is typically a "one wire system" with the return portion of the circuit being completed by a ground return; i.e., from the outer primer body or outer housing to the cartridge case, from the cartridge case to the barrel and from the barrel to the gun and then to ground. The ground may utilize the gun mount, the carrying vehicle or an electrical conducting wire, bus or similar path.

Where very large energy paths are required and/or a two or more wire system is desired, existing systems offer very limited room for such an expansion. Enlarging existing "routes" may threaten the physical integrity of the bolt or breechblock. In addition, safing interlocks, the requirement that the breechblock functions at up to 1,000 shots a minute or more, and the need for an insulated energy input path to the bolt all create problems.

Systems for electrically igniting the propellant charge in gun-fired ammunition have long been known in the prior art. Typical examples of such systems are found in the following U.S. Pat. Nos. 1,108,717 of Davis, 3,169,333 of Scanlon, Jr., 3,714,728 of Perkins et al and 3,748,770 of Mitchell. British patent specification 1,102,201 and German Offenlegungsschrift DE 29 49 130 Al also disclose electrical contact ignition systems for ammunition. The Perkins et al and Mitchell patents and the German Offenlegungsschrift appear to disclose systems using the most conventional approach to electrical ignition: i.e., a single contact centrally located at the rear face of the ammunition round. Such arrangements are clearly subject to the deficiencies and disadvantages noted hereinabove.

The arrangement of Mitchell, while perhaps avoiding some of these problems by utilizing two fixed electrical contacts in the bolt face, is subject to the problems of added complexity of construction and, in systems where the bolt is small or limited in strength or the current flows are very high (as when large conductors are required), such an arrangement becomes rather impractical as an approach to avoiding the problems of the single conductor igniter.

The British patent relates to initiating systems for propellant charges, clearly directed only to ammunition in large naval guns and the like. It requires charge bags prepared with two strips of tin foil encircling the propellant charge. The barrel includes a threaded hole into which a spark plug is inserted. Not only is a main spark plug required, but there is an auxiliary spark gap to assist in maintaining a spark across the main spark gap. Such arrangements are impractical for systems of the type to which the present invention is directed.

The Davis patent relates to the firing of ammunition in guns mounted on aircraft, probably one of the earliest recoilless rifles. The bore of the gun is open on both ends. Firing the weapon involves blowing the projectile out the muzzle by resort to a compensating mass which is projected rearward through the breech of the gun, balancing the longitudinal strains on the gun and thereby eliminating the shock of recoil. The only way electrical ignition can be accomplished in such an arrangement is by the use of an electrical firing pin mounted in the side of the barrel. The cartridge case has an annular groove into which is mounted a continuous metal band or ring which is insulated from the body of the cartridge case. This is a one wire circuit with the return path being through the metal parts of the gun, mount, etc.

SUMMARY OF THE INVENTION

In brief, arrangements in accordance with the present invention provide two wire electrical circuitry for conveying high electrical levels to a cartridge or similar device which is chambered in a gun or other weapon. This involves the provision of plural insulated contacts located in the gun barrel and exposed to the cartridge chamber or gun bore in a manner such that they connect electrically to mating insulated contacts which are built into the cartridge case and/or projectile. The contacts which are employed in these arrangements are matched to the energy load to be transferred, thereby achieving maximum efficiency and effectiveness of performance.

In one particular arrangement in accordance with the present invention, a pair of lead wires is installed in a gun barrel and insulated therefrom. The lead wires feed through the sidewall of the barrel and include annular contact rings installed in a side-by-side configuration in a common insulator member which insulates the conductors from the barrel and from each other. The associated cartridge or projectile designed for firing in a weapon of this sort is provided with external conductors which are positioned to contact the annular rings of the chamber when the cartridge or projectile is mounted in the chamber for firing. These electrical conductors of the cartridge may include one or more leads extending to the periphery of the cartridge for a given ring connection where they may be matching external annular rings or portions thereof. It is preferred to incorporate some sort of a spring arrangement or resilient insulator in at least one of the contacts of a contact pair to provide further assurance of developing a reliable electrical connection when the cartridge or projectile is in position for firing within the weapon chamber. A number of different structural configurations are disclosed for achieving the desired resiliency of the annular ring contacts.

In another particular arrangement in accordance with the present invention electrical ignition systems utilizing annular contacts between firing chamber and cartridge incorporate one or more external switches for enhancing the safety and reliability of the firing systems. Variants of this arrangement are disclosed for both single barrel, multiple rotating barrel, and multiple round rotating chamber gun firing systems.

BRIEF DESCRIPTION OF THE DRAWINGS

A better understanding of the present invention may be realized from a consideration of the following detailed description, taken in conjunction with the accompanying drawing in which:

FIGS. 2A, 2B and 2C are schematic representations of portions of a gun barrel configured in accordance with the present invention, while

DESCRIPTION OF THE PREFERRED EMBODIMENTS

Figure 1:
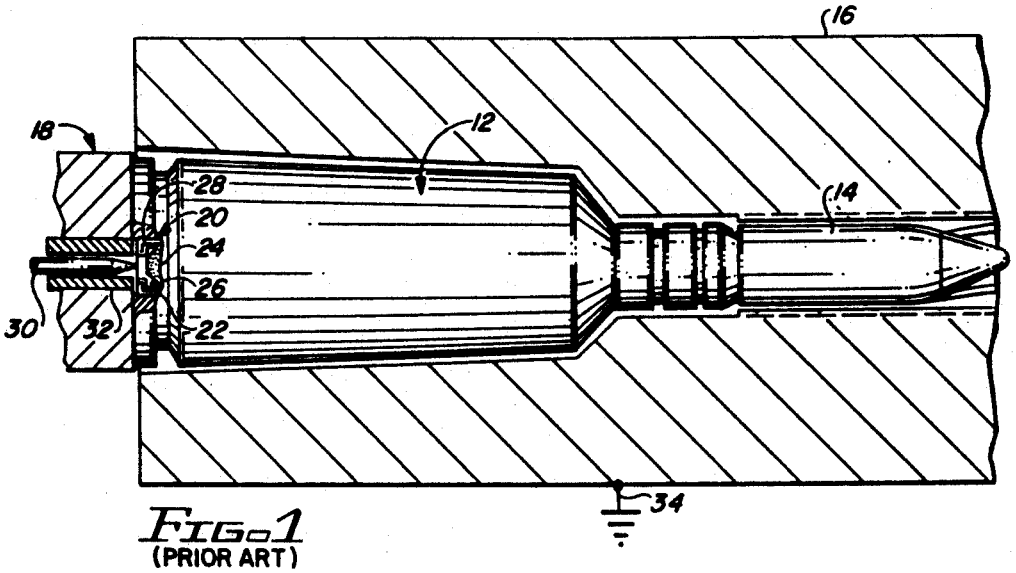
FIG. 1 (PRIOR ART)
FIG. 1 is a schematic sectional view of a typical electrically primed cartridge firing arrangement of the prior art.

In the conventional prior art arrangements schematically depicted in FIG. 1, an unfired cartridge 12 with projectile 14 is shown mounted in the firing chamber of a barrel 16 in association with a bolt assembly 18. The cartridge 12 is provided with an electrically ignited primer 20 encased in a circumferential primer housing 22 and comprising an ignition charge or squib 24 adjacent a primer contact 26 separated from the housing by a primer insulator 28. The bolt assembly 18 contains a coaxial firing pin 30 connected in an external electrical circuit (not shown) and insulated from the bolt assembly by an insulating sleeve 32. The return path for current from the firing pin 30 is a ground connection 34 which may incorporate circuit paths through the barrel and/or the bolt and receiver. As previously noted, this type of ground return is not effective for the transfer of very high energy pulses.

Figure 2A:
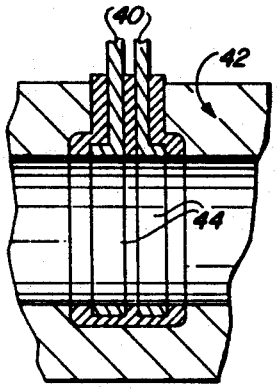
Figure 2B:
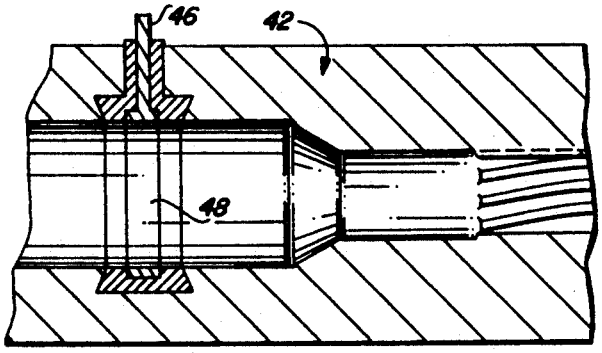

FIGS. 2A and 2B are side sectional views of the firing chamber portion of a gun barrel incorporating features of the present invention. In FIG. 2A, a pair of lead wires 40 are shown extending through a sidewall of the firing chamber 42 and connecting with a corresponding pair of annular contact rings 44 recessed into the interior wall of the firing chamber 42. These are configured to make electrical contact with corresponding rings in a cartridge, in a manner to be described hereinafter.

FIG. 2B is a similar view showing a single lead wire 46 extending through the sidewall of firing chamber 42 and making contact with an annular conducting ring 48 which is recessed into the wall of the chamber 42.

Whereas the dual contact connections depicted in FIG. 2A are designed to transfer electrical energy pulses to and from the cartridge in a two wire system, the single annular contact of FIG. 2B is only one part of a two wire system, the other connection being made positively through an electrically energized firing pin such as that which is depicted in FIG. 1. The combination of the annular ring contact 48 of FIG. 2B with the insulated firing pin 30 of FIG. 1 obviates the problems in a ground return system as described hereinabove.

Figure 2C:
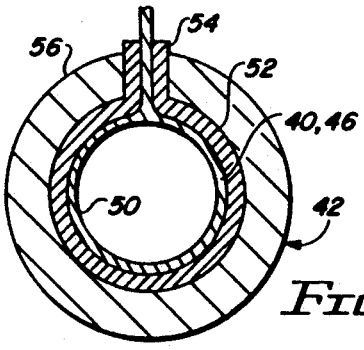
Figure 2D:
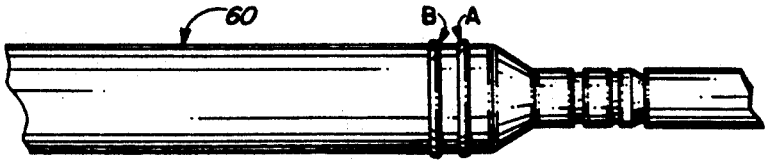
FIG. 2D represents a portion of a cartridge corresponding to the gun barrel of FIG. 2A.

FIG. 2C is a transverse sectional view of one of the annular rings 44, 48 of FIG. 2A or FIG. 2B showing how it is embedded in the wall of the chamber 42, flush with the interior surface 50 and separated from the metal wall of the chamber 42 by an encasing insulator 52 which extends outwardly through the opening 54 to the exterior surface 56 of the chamber 42.

Figure 3A:
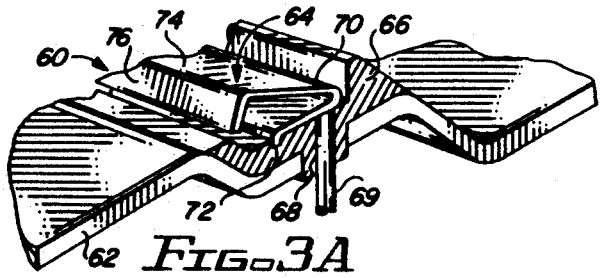
FIG. 3A is a schematic view of a cartridge case illustrating one particular form of contact strip in accordance with the invention.

FIG. 3A is a schematic view of a portion of a cartridge case 60 which may be used in a firing chamber as represented in FIGS. 2A-2C. The cartridge case 60 is shown with a wall 62 configured to receive a resilient contact strip 64 which is mounted in and electrically separated from the wall 62 by an annular insulator 66. The insulator 66 extends into an opening 68 through which a wire lead in 69 extends from the contact strip 64 to the interior circuitry of the cartridge 60.

The annular contact ring 64 as shown in FIG. 3A is formed of a springy material—e.g., copper, brass or other resilient material with good conducting properties—by folding the strip to form an acute angle along an edge 70. The inner side of the contact ring 64 terminates in an inwardly directed flange 72 which helps to anchor the strip 64 in the annular insulating ring 66. The outer portion 74 of the annular contact ring 64 is suspended by the fold 70 and is free to rotate inwardly when contacting one of the annular ring contact members installed in the firing chamber, as shown in FIG. 2. The portion 74 terminates in an inwardly beveled edge 76 which enables the cartridge 60 to be inserted and withdrawn from the firing chamber without catching on any surface irregularities along the wall of the firing chamber.

The remaining views in FIG. 3 depict alternative arrangements for the annular contact ring 64 shown in FIG. 3A. FIG. 3B shows an annular contact ring 64B which may be formed by folding a strip of metal back on itself about a core, crimping the opposite edges together to form a plurality of blade elements 80 and withdrawing the core, after which the roll portion 82 is flattened slightly to develop the configuration shown. The blade elements 80 make electrical contact with circuitry inside the cartridge case; the configuration and material of the flattened roll portion 82 serve to develop the desired resilient contact with the annular contact rings in the firing chamber of the weapon.

Figure 3C:
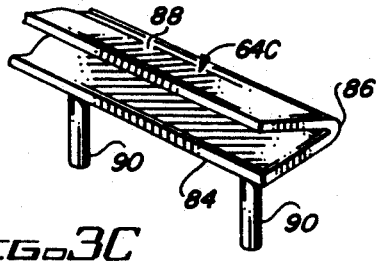

The arrangement of annular contact strip 64C in FIG. 3C is somewhat similar to the contact member 64 depicted in FIG. 3A, in that it comprises a strip 84 folded to develop an acute angle at the edge 86, thereby developing the desired resiliency of the outer contact portion 88. Pegs 90 are connected at regular intervals to the inner portion of the contact ring 64C to provide connection to internal circuitry in the cartridge 60.

Figure 3D:
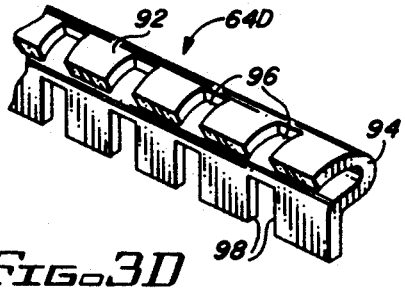

FIG. 3D shows another alternative contact strip 64D for the cartridge 60 of FIG. 3A. In this figure, the annular strip 64D is shown constructed of a folded metallic strip 92 which is folded to define an acute angle at the edge 94. The upper portion has a plurality of notches 96 cut therein to enhance the resiliency of the contact ring 64D. The inner edge of the member 64D is also notched to provide a plurality of connectors 98 to internal circuitry in the cartridge 60.

Figure 3E:
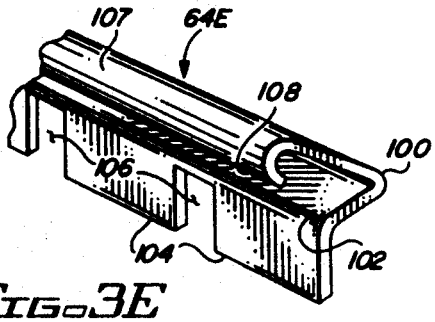

Still another alternative configuration of an annular contact strip 64E is shown in FIG. 3E. This is formed from a metal strip folded into an acute angle at the edge 100. The underneath portion has a brake line at 102 with a plurality of radially inwardly directed blade members 104 defined by notches 106. The outer portion of the annular contact member 64E is resiliently supported at the angle 100 and has an inwardly directed edge 108 which is curled from the portion 107 in a smooth curve to permit insertion and withdrawal of the cartridge 60 in the firing chamber of FIG. 2 without hooking on any interior surface irregularities.

Figure 4A:
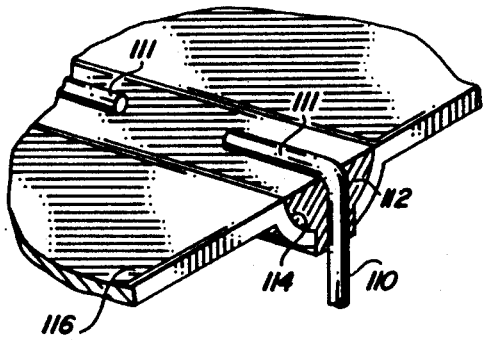
FIGS. 4A and 4B are schematic views, perspective and cross-sectional, of another particular arrangement of a cartridge and annular ring for use in accordance with the present invention.
Figure 3B:
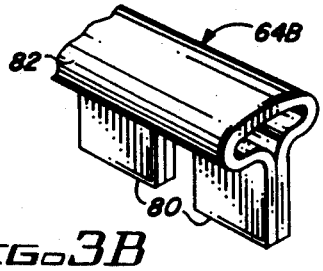
FIGS. 3B-3E are schematic views of variations of the contact strip shown in FIG. 3A.
Figure 4B:
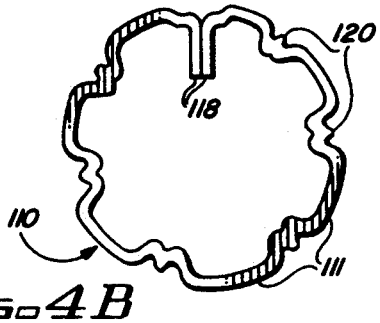

FIGS. 4A and 4B show how an annular contact mounted in a cartridge wall may be formed of a bent wire ring. This will have the exterior appearance of an intermittent conductor 110 mounted in an annular insulating strip 112 within a circumferential recess 114 in the cartridge wall 116. This configuration of the bent wire ring 110 is developed as shown in the side view of FIG. 4B, in which a wire 110 is formed in a circle with its two ends 118 bent inwardly to provide the internal connection to circuitry in the cartridge 116. The wire is crimped at points 120 to permit circumferential compression of the annular conductor, thereby developing the exposed contact portions 111 between the crimp points 120.

Figure 5A:
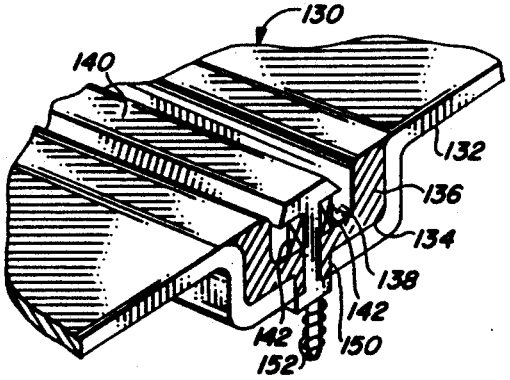
FIGS. 5A and 5B are schematic view of a portion of a cartridge case and a solid contact ring mounted thereon with a resilient support associated therewith.
Figure 5B:
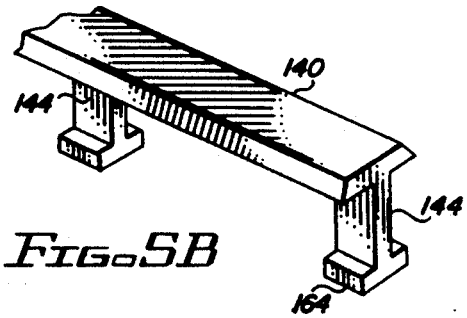
Figure 6A:
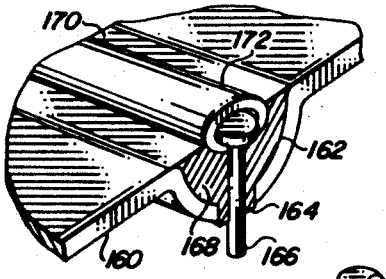
FIG. 6A is a schematic view of a portion of a cartridge case provided with a composite contact ring in accordance with the present invention.
Figure 6B:
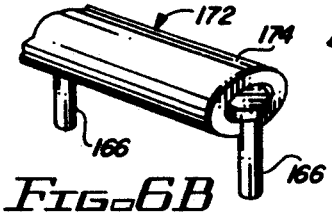
FIGS. 6B-6E illustrate schematically particular variants of the composite ring of FIG. 6A.
Figure 6D:
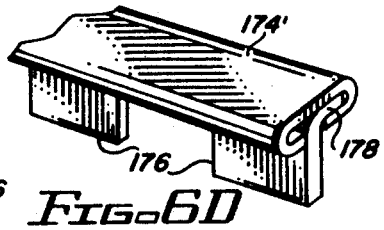
Figure 6C:
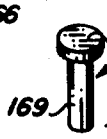
Figure 6E:
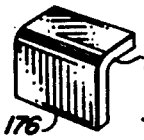

FIGS. 5A and 5B illustrate in schematic representation still another variant of an annular contact ring for a weapon cartridge. In FIG. 5A, a portion of cartridge 130 is represented having a wall 132 which is shaped to define an annular recess 134 in which a circumferential insulator 136 is installed. The insulator 136 also has an annular recess 138 in which a solid contact ring 140 is mounted. Between under-surfaces of the solid annular contact ring 140 and the base of the recess 138 are one or more resilient spring members 142. These may be resilient pads positioned at regular intervals about the insulator 134 or, alternatively, these may be annular in form, extending circumferentially about the insulator 134. The solid contact ring 140 is supported and retained in position by a plurality of inwardly directed blade members 144 having laterally extending portions 146 which spread outwardly to stabilize the ring within the recess of the annular insulator 134. These members 144 extend to the interior of the cartridge 130 through openings 150 where wire connections 152 to internal circuitry are attached.

FIG. 6, in views A–E, illustrates still another possible arrangement of a composite ring for an annular contact installed in a cartridge. In FIG. 6A, a cartridge wall 160 is shown having an annular recess 162 with an opening 164 through which an electrical contact member 166 extends, separated from the cartridge wall surrounding the opening 164 by insulation 168. The insulation 168 is part of an annular insulating strip 170 which extends about the cartridge 160 within the recess 162 and supports an annular contact ring member 172 which is attached to the electrical connector 166. As shown in views 6B and 6C, the annular contact member 172 comprises a partially flattened, resilient tubular element 174 in which conductor elements 166 are mounted. The conductor elements 166 comprise a radially inwardly directed pin 169 attached to a flattened head portion 171 for retention within the member 172.

Views 6D and 6E show a variant of the member of views 6B–6C, wherein a flattened tube 174' is provided with a plurality of radially inwardly extending blade members 176 for connecting to internal circuitry within the cartridge. The blade members 176 are held in place in the tube member 174' by a right-angled flange 178. Where the ring contacts are made up of separate components and are joined together for mechanical or electrical continuity, the joint/connection may be mechanical or welded, soldered, pressed or formed by other similar techniques which permit the passage of electrical energy without excessive resistance, burning, arcing or heating.

Figure 7A:
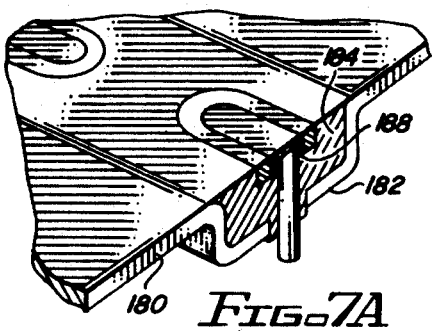
FIGS. 7A and 7B are schematic partial views of a cartridge case having external contact members, showing different ways of providing resilient support for the contacts.
Figure 7B:
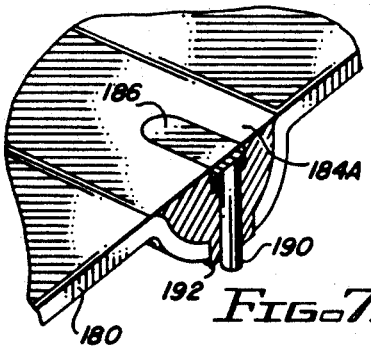

FIGS. 7A and 7B represent still other variants of the cartridge wall contact arrangements in accordance with the present invention. In these figures, a cartridge wall 180 is shown having a recess 182 in which an annular insulator 184 is positioned. Contact elements 186 are embedded in the insulation 184. In FIG. 7A, these contact elements 186 are shown resiliently supported by a plurality of resilient members 188 installed between the inner surface of the contacts 186 and a corresponding recess in the insulation ring 184. The elements 188 may comprise springs or some other compressible member.

In FIG. 7B, the contact 186 is shown mounted directly in the insulating material 184A, which itself is a resilient material, thereby providing the desired resilience for the contact 186. Contacts 186 have leads 190 which are directed radially inward to extend through openings 192 in the wall 180 and connect to circuitry within the cartridge.

Figure 8:
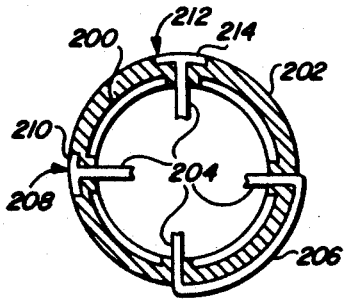
FIG. 8 is a schematic cross-sectional view of still another arrangement of a cartridge case with external electrical contacts in which a plurality of contacts are provided at one axial location.

FIG. 8 is a schematic transverse sectional view showing a way in which a plurality of cartridge contacts may be located at a single axial position. In this view, the cartridge case wall 200 is shown encased within an insulating layer 202. The cartridge case wall 200 has a plurality of openings through which leads 204 extend, surrounded by extensions of the insulation coating 202. Exterior contacts are shown connected to these leads 204 in various forms. Contact 206 extends about a quarter section of the cartridge case 202, outside of the insulation coating 202 and connecting between adjacent leads 204. Reference numeral 208 designates a single contact member having a flattened head portion 210 which is connected to an internal lead 204 extending through a corresponding opening in the case 200. At the top of the figure, a contact member 212 is shown having an extended contact area 214 projecting partially about (through an angle of about 30 degrees) the circumference of the case 200, embedded in the insulation coating 202.

Figure 9:
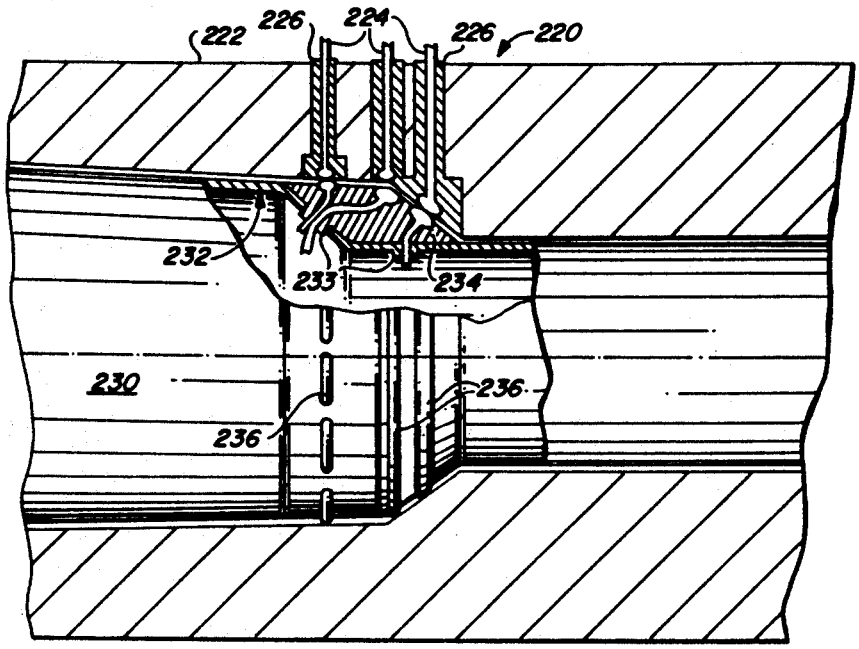
FIG. 9 is a schematic cross-sectional view of a gun barrel and installed cartridge case illustrating ways in which connections can be provided to the annular ring contacts of FIGS. 4-6.

It should be kept in mind that, although the annular contact arrangements of FIGS. 3–7 are shown in the form of a single annular member, these may be provided in pairs to accommodate to the dual annular contact members embedded in the firing chamber as shown in FIG. 2A. This is clarified in the schematic cross-sectional view of FIG. 9 in which three pairs of mating annular contact arrangements are depicted. In this figure, a barrel 220 is shown having a firing chamber wall 222 in which three distinct barrel contact leads 224 are mounted within corresponding insulation elements 226. Within the firing chamber 222 is installed a cartridge 230, partially broken away, to show the cartridge case wall 232 having surrounding insulation 234 in which cartridge contacts 236 are positioned. These contacts 236 may be of any of the configurations depicted in FIGS. 3–8 and described hereinabove. Openings 233 in the cartridge case wall 232 admit connections from the cartridge contacts 236 to internal circuitry for firing the cartridge.

The features of the present invention which these various embodiments share in common and which are considered important to the developments of preferred embodiments of the invention include the provision of contact paths in a two wire system for transmitting high energy electrical pulses into and out of the cartridge firing circuit. In addition, the cartridge contacts are mounted in various ways to develop a resiliency for the contacts, either by a spring or other resilient support underneath the annular contact members or by incorporating in the annular contact member a resiliently deformable outer portion for establishing a reliable connection with the annular contact ring embedded in the firing chamber. The annular contact members of the cartridge are shaped to prevent hooking on any interior surface irregularities in the firing chamber wall as the cartridge is inserted or withdrawn from the weapon.

Figure 10:
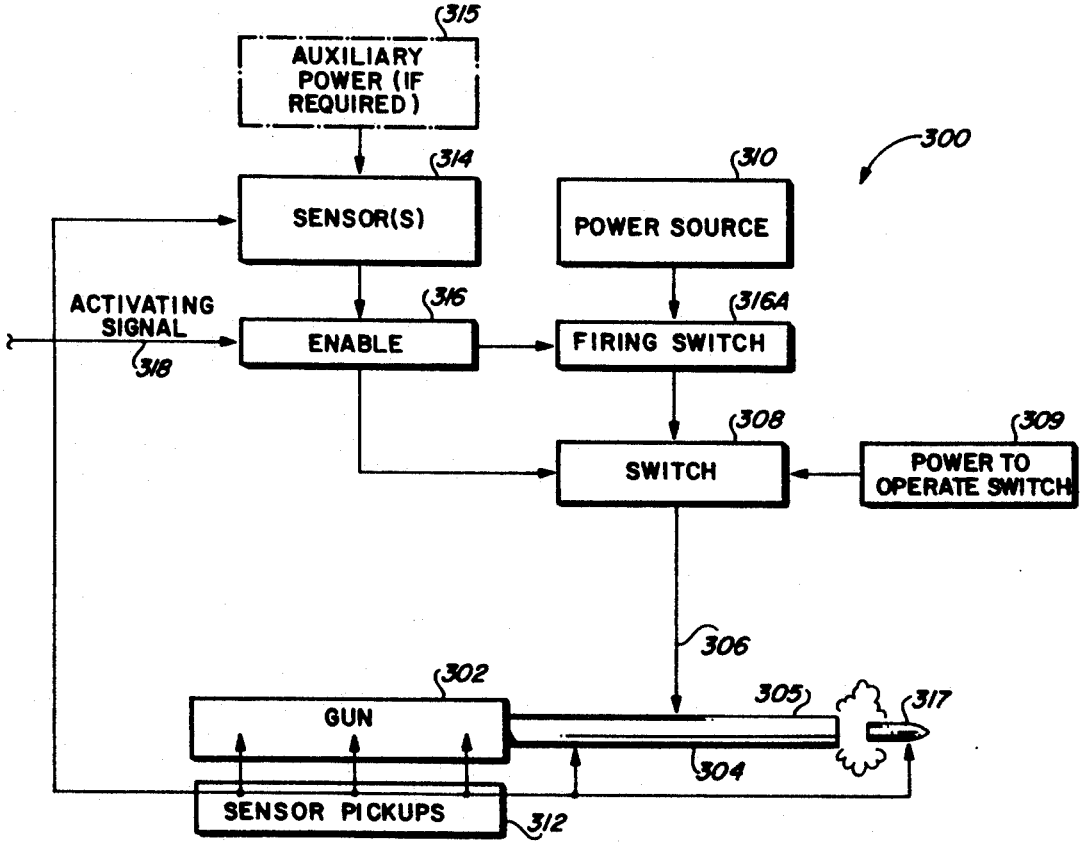
FIG. 10 is a schematic block diagram of a single gun firing system in accordance with the present invention.

Another particular embodiment of the present invention is represented in the schematic block diagram of FIG. 10. In the system 300 of FIG. 10, a single barrel gun 302 is shown having a barrel 305 and firing chamber 304 corresponding to any one of those disclosed hereinbefore. In series circuit with the external electrical firing signal path 306 is a switch 308. This switch 308 is wired in series with the electrical conductor 306 extending between the electrical power source 310 and the firing chamber 304.

The gun 302 and the barrel 305 and firing chamber 304 are shown equipped with a plurality of sensor pickups 312 connected in parallel to a sensor block 314. One of the sensors 312 is also provided to monitor the exit of a projectile 317 from the barrel 305.

The switch 308 in the circuit path between the power source 310 and the firing chamber 304 serves at least three functions. It prevents power being applied to the ammunition in the firing chamber 304 until the system 300 is at the required time/location in the firing cycle so that the current flow does not occur between moving or opening or closing contacts which could cause arcing. The switch 308 also restricts energy flow to periods when the ammunition can be safely fired—e.g., when the bolt is locked, the ammunition is properly chambered, etc. Switch action can also serve to control the duration of the power input.

The switch 308 may be mechanical, electrical, electronic or any other design known to the art. If the energy level is low and timing is less precise, a mechanical system would be adequate. If lower levels are high and/or precise timing or timing duration is important, a high capacity electronic switch such as a thyristor or other similar electronic device can be used. If an actuating circuit is required to operate the switch 308, it may be provided by the optional power block 309. Also, optional auxiliary power block 315 may be provided to supply any needed power to the sensors 314.

The switch 308 obtains its actuating signal from the sensor block 314 via a firing enable switch 316. Thus, the gun can only be fired in response to activating signal on line 318 to the firing enable switch 316 if all of the sensor pickups 312 and sensors 314 indicate a GO condition.

As an alternative to the position of the switch 316 in the line from the sensor block 314 to the switch 308, the firing enable switch may be connected in the position of the block 313A, in series with the power source 310. As a further alternative, enable switches 316 and 316A could both be provided, connected in tandem to an activating signal on line 318.

Figure 11:
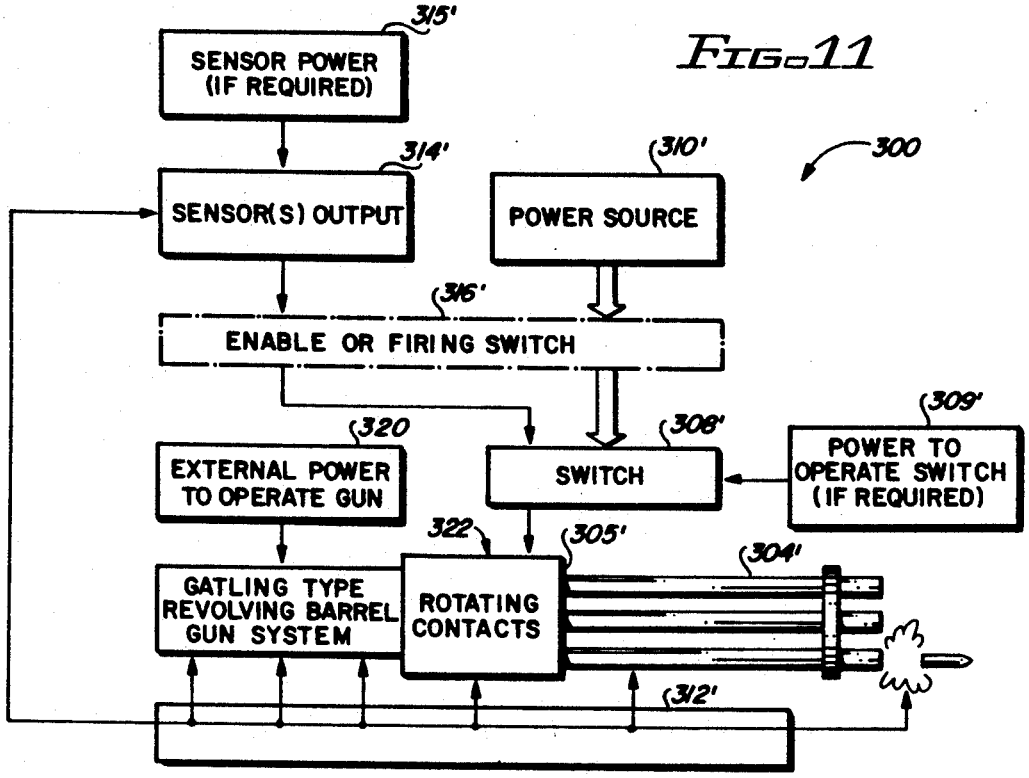
FIG. 11 is a schematic block diagram of a rotating barrel gun firing system in accordance with the present invention.

FIG. 11 shows a system like the single barrel gun system 300 of FIG. 10, adapted to a multiple barrel gun 330 of the Gatling revolving barrel type. In the block diagram of FIG. 11, like elements are designated with the same reference numerals as in FIG. 10, with a prime designation affixed. In addition to the components in the system 300 of FIG. 10, the system 300' of FIG. 11 requires external power to operate the gun, represented by the reference number 320 and a rotating contact mechanism 322. The rotating contact mechanism 322 must not only serve to make electrical contact with a rotating system but must also time the triggering pulses to the proper firing chamber at the appropriate gun cycle time.

Figure 12A:
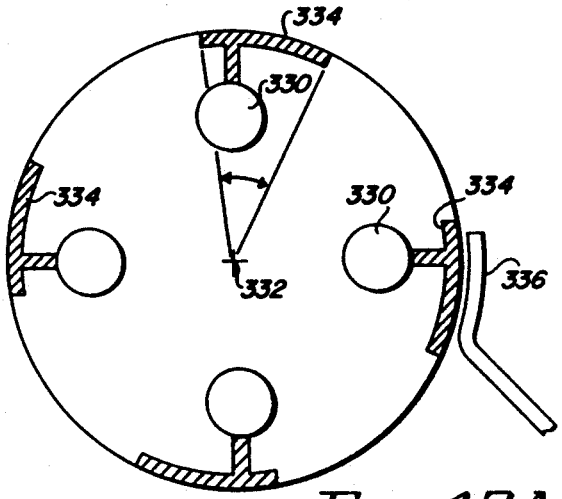
FIGS. 12A-12C are schematic views illustrating the details of particular portions of the system of FIG. 11.
Figure 12B:
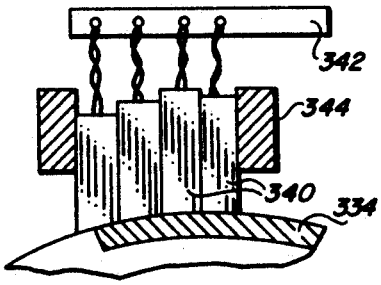
Figure 12C:
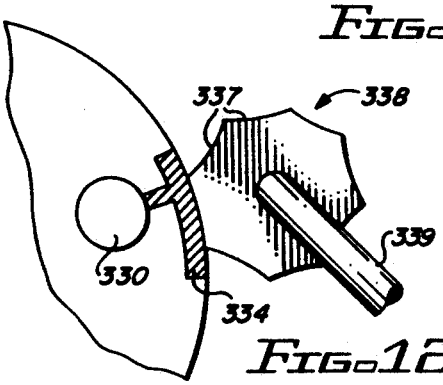

Suitable structural configurations for use in the rotating contact mechanism 322 of FIG. 11 are depicted in FIGS. 12A, 12B and 12C. FIG. 12A schematically depicts four gun barrels 330 mounted in four quadrants about an axis 332 of barrel rotation. Each of the firing chambers of the gun 330 is electrically connected to a corresponding contact ring segment 334 extending about a portion of the periphery of the rotation circle. A pressure contact 336 is shown mounted at a fixed point about the periphery of the rotation circle for making contact with respective segments 334 as the barrel assembly rotates. For low energy sources, a simple sliding contact such as the single contact 336 of FIG. 12A should be adequate. The mechanical connection between the fixed contact 336 and movable segments 334 is established before actuating the firing circuit. One of the sensors 312' (FIG. 11) uses the rotational location of the barrel to determine the firing time.

For a two wire system in the arrangement depicted in FIG. 11, two side-by-side contacts for each individual gun barrel may be used, corresponding to the arrangement of FIG. 2A. The contacts may use a spring loaded solid metal contact or carbon brushes, as used on electric motors. If it is desired to reduce brush wear and increase cooling time, a separate set of contact rings may be provided for each gun barrel. Multiple thyristors can be used in the switch 308' to control power input to each individual gun barrel contact separately.

A brush arrangement for the stationary contact is depicted in FIG. 12B as comprising a plurality of contacts such as carbon brushes 340 individually connected to a power bus 342 and held in position to maintain pressure contact against a rotating contact ring 334 by a holder 344.

A rotating contact suitable for higher speed which exhibits less frictional wear is shown in FIG. 12C. The lobes or sectors 337 of the rotating member 338 each have a concave curve with a radius of curvature which matches the radius of the contact ring element 334. The rotating member 338 is supported by a power bus arm 339. Timing of the rotation of the rotating member 338 can be controlled by the contact ring friction or by other appropriate means, such as by a dog and pin (not shown) aligned with the contact ring 334. The rotating member 338 may also be circular or cylindrical or may be composed of a compressible resilient conductor.

Figure 13:
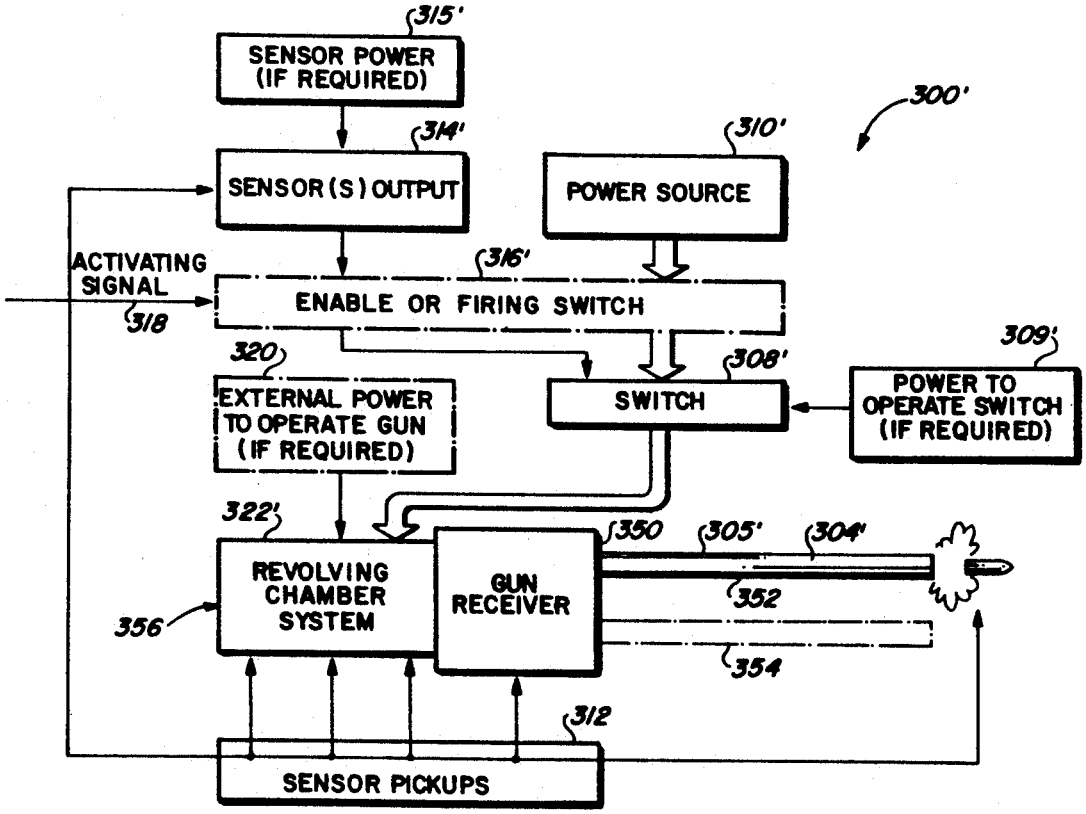
FIG. 13 is a schematic block diagram of a rotating chamber gun firing system, such as a revolver, with a fixed barrel(s) in accordance with the present invention.

FIG. 13 shows a system like the Gatling revolving barrel gun system of FIG. 10, adapted to a revolving chamber or revolving cylinder type gun system. Such a gun uses a revolving cylinder chambered for the cartridge involved and may load and extract the cartridges only from the rear or may eject a cartridge which is cylindrical by pushing it through the cylindrical chamber. Another suitable type of cylinder is the open cylinder which is typified by triangular cross-sectioned cartridges or "Trounds" which are loaded radially inward. Revolving chamber guns typically have a single barrel 352 or sometimes two or more barrels 352, 354.

In the block diagram of FIG. 13, like elements are designated with the same reference numerals as in FIG. 10, with a prime designation affixed. In addition to the components in the system 300 of FIG. 10, the gun receiver 350 acts as a housing for the barrel(s) 352, 354 and the revolving chamber system 356. If external power is required to operate the gun, it is supplied from a power source 320. The revolving chamber system 356 serves not only to hold the cartridges during firing and to provide electrical contact with incoming power from the switch 308' but also to time the triggering pulses to the proper firing chamber at the appropriate gun cycle time via rotating contacts 322'. This will use the sensor pickups 312. Electrical circuitry to the revolving chamber 356 may alternatively be directed through the gun receiver 350.

A number of benefits accrue from the use of particular embodiments of the present invention. The disadvantages of prior systems which rely on a common ground return path are eliminated, and the control and reliability of electrical ignition of cartridges being fired by a weapon are enhanced. Existing weapons may be modified to incorporate different arrangements in accordance with the present invention.

In such a case, existing firing systems need not be removed, and a modified weapon could be adjusted to fire conventional rounds readily. Cost savings are realized by the deletion of the firing pin and associated components. Further reliability and safety result from the incorporation of my disclosed switching arrangements in conjunction with the disclosed structural configurations of the contacts disclosed herein.

Although there have been described hereinabove various specific arrangements of a high capacity electrical cartridge interconnect in accordance with the invention for the purpose of illustrating the manner in which the invention may be used to advantage, it will be appreciated that the invention is not limited thereto. Such arrangements include devices which, when "fired", produce electrical energy out of the cartridge and firing chamber. Any and all modifications, variations or equivalent arrangements which may occur to those skilled in the art should be considered to be within the scope of the invention as defined in the annexed claims.

What is claimed is:

1. An electrically ignitable cartridge case for firing with a firing chamber of a gun in response to applied electrical pulses, said firing chamber having at least one annular contact ring mounted in an interior wall thereof, said cartridge case comprising:

annular contact means for conducting electrical current to powder igniting means within the cartridge case;

said annular contact means being mounted to extend about said powder igniting means and configured and positioned to make electrical contact with the corresponding annular contact ring in the interior wall of the firing chamber when the cartridge case is chambered within the gun.

2. The cartridge case of claim 1 wherein said annular contact means comprise a pair of coaxial side-by-side annular contact rings mounted within recesses in the cartridge case and isolated therefrom by corresponding annular insulators which are mounted between the contact rings and the cartridge case.

3. The cartridge case of claim 1 wherein said annular contact means comprise at least one annular contact ring mounted within a corresponding recess in said cartridge case and isolated therefrom by an annular insulator mounted between the contact ring and said corresponding recess in the cartridge case.

4. The cartridge case of claim 3 wherein said cartridge case annular contact ring comprises a resilient contact strip which is mounted in and surrounds the cartridge case at a predetermined axial location.

5. The cartridge case of claim 4 wherein said cartridge case is shaped to define said corresponding recess as an annular recess for receiving and embedding the annular insulator therein.

6. The cartridge case of claim 5 wherein said insulator is configured to define another annular recess for receiving and embedding the resilient contact strip therein.

7. The cartridge case of claim 6 further including electrical circuit means extending through a gap in said cartridge case and through said annular insulator to connect to said resilient contact strip.

8. The cartridge case of claim 7 wherein said resilient contact strip is formed of a springy material with good conducting properties.

9. The cartridge case of claim 1 wherein said cartridge case annular contact ring comprises a generally circumferential bent wire ring having two ends thereof adjacent one another and directed radially inward to provide internal connection to electrical circuitry within the cartridge case.

10. The cartridge case of claim 9 wherein said wire ring is crimped at spaced intervals about its circumference to permit circumferential compression of the annular contact ring, the outermost portions of the ring between the crimped portions serving to develop exposed contact portions for making contact with the annular contact ring mounted in the wall of the firing chamber.

11. The cartridge case of claim 10 wherein said crimped portions are embedded in an annular insulator which is mounted within an annular recess in the cartridge case wall.

12. The cartridge case of claim 1 further comprising an annular insulator embedded in the wall of the cartridge case and wherein the cartridge case annular contact ring comprises a solid ring having a generally T-shaped cross-section with a radially inward edge at the base of the T-shaped cross-section.

13. The cartridge case of the claim 12 wherein said annular insulator includes an annular recess for receiving the annular contact ring therein.

14. The cartridge case of claim 13 further including resilient means positioned between the cross bar portion of the T-shaped ring configuration and the recessed surfaces of the annular insulator to locate the contact ring therein.

15. The cartridge case of claim 14 further including retaining means affixed to the radially inward edge of the annular contact ring inside the cartridge case and electrical wiring extending from the radially inward edge of the contact ring to said powder igniting means within the cartridge case.

16. The cartridge case of claim 1 wherein said annular contact means comprise a plurality of circumferentially spaced contact elements embedded in the annular insulator with outer surfaces positioned to contact the annular contact ring which is mounted in the interior wall of the firing chamber and having inner end portions extending through the cartridge case wall to electrical circuitry within the cartridge for firing the cartridge.

17. The cartridge case of claim 16 further including resilient support elements positioned to support the outer surface of the contact elements within recesses of the annular insulator.

18. The cartridge case of claim 16 wherein the contact elements are imbedded in the annular insulator and wherein the annular insulator comprises a resilient insulating material for resiliently supporting the contact elements therein.

19. The cartridge case of claim 1 wherein the firing chamber has at least three annular contact rings mounted in the interior wall thereof in coaxial side-by-side relationship and wherein the annular contact means comprise a like plurality of annular members disposed in coaxial side-by-side relationship to mate and make corresponding contact with said annular contact rings of the firing chamber when the cartridge case is chambered in the gun.

20. An electrically ignitable cartridge case for firing within a firing chamber of a gun in response to applied electrical pulses, said firing chamber having at least one annular contact ring mounted in an interior wall thereof, said cartridge case comprising:

annular contact means for conducting electrical current to powder igniting means within the cartridge case;

said annular contact means being configured and positioned to make electrical contact with the corresponding annular contact ring in the interior wall of the firing chamber when the cartridge case is chambered within the gun;

wherein said annular contact means comprise at least one annular contact ring mounted within a corresponding recess in said cartridge case and isolated therefrom by an annular insulator mounted between the contact ring and said corresponding recess in the cartridge case, said cartridge case annular contact ring comprising a resilient contact strip which is mounted in and surrounds the cartridge case at a predetermined axial location;

wherein said cartridge case is shaped to define said corresponding recess as an annular recess for receiving and embedding the annular insulator therein, and wherein said insulator is configured to define another annular recess for receiving and embedding the resilient contact strip therein;

further including electrical circuit means extending through a gap in said cartridge case and through said annular insulator to connect to said resilient contact strip, said resilient contact strip being formed of a springy material with good conducting properties; and wherein said contact strip is rendered more resilient by folding the strip to form an acute angle along one edge thereof.

21. The cartridge case of claim 20 wherein said contact strip terminates in an inwardly directed flange which penetrates and serves to anchor the strip in the annular insulator.

22. The cartridge case of claim 21 wherein an outer portion of the folded contact strip terminates in an inwardly beveled edge.

23. The cartridge case of claim 22 wherein the inwardly bevelled edge of the outer portion is curled from said outer portion in a smooth curve to ease insertion and withdrawal of the cartridge case in the firing chamber.

24. The cartridge case of claim 20 wherein the contact strop comprises a slightly flattened roll portion formed between crimped opposite edges of a rolled metal strip.

25. The cartridge case of claim 20 further including a plurality of radially inwardly directed pegs connected to an inner portion of the strip at regularly spaced intervals to provide connection to internal circuitry within the cartridge case.

26. The cartridge case of claim 20 further comprising means in an outer portion of the folded contact strip defining a plurality of notches cut therein to enhance the resilience of the contact strip.

* * * * *